US006491368B1

(12) United States Patent
Cipolla et al.

(10) Patent No.: US 6,491,368 B1
(45) Date of Patent: Dec. 10, 2002

(54) PRIMING SYSTEM FOR MULTICOLOR INK JET PRINTERS

(75) Inventors: David Cipolla, Macedon, NY (US); Steven J. Dietl, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/999,488

(22) Filed: Dec. 3, 2001

(51) Int. Cl.[7] ..... B41J 2/165
(52) U.S. Cl. ..... 347/23; 347/29; 347/30
(58) Field of Search ..... 347/23, 29, 30, 347/32, 35; 417/410

(56) References Cited

U.S. PATENT DOCUMENTS

| | | | | |
|---|---|---|---|---|
| 4,571,599 A | | 2/1986 | Rezanka | 347/57 |
| 4,849,774 A | | 7/1989 | Endo et al. | 347/56 |
| 5,108,271 A | * | 4/1992 | Berges et al. | 417/410 |
| 5,404,158 A | | 4/1995 | Carlotta et al. | 347/32 |
| 5,519,425 A | | 5/1996 | Dietl et al. | 347/87 |
| 5,572,243 A | | 11/1996 | Hermanson | 347/29 |
| 5,757,398 A | | 5/1998 | Anderson | 347/32 |
| 5,971,531 A | | 10/1999 | Dietl et al. | 347/86 |
| 6,123,408 A | * | 9/2000 | Ishize et al. | 347/30 |
| 6,130,684 A | | 10/2000 | Premnath et al. | 347/30 |
| 6,220,699 B1 | | 4/2001 | Taylor et al. | 347/85 |

FOREIGN PATENT DOCUMENTS

JP 7-132617 * 5/1995 ..... B41J/3/04

* cited by examiner

*Primary Examiner*—Anh T. N. Vo
(74) *Attorney, Agent, or Firm*—Robert Chittum

(57) ABSTRACT

A priming system for selectively priming one of the two printheads of a multicolor ink jet printer. When one of the printheads require periodic priming, the printheads are transported to the printer's maintenance station where individual caps are moved to cover the nozzle faces of the printheads. The priming system has two individual peristaltic pumps, each one of which is connected to a respective one of the caps. The two peristaltic pumps have a single mechanical input to drive selectively one of the pumps and not the other by a positionable swing gear. Each one of the pumps is adapted to prime only one of the printheads. The swing gear engages the drive gear of one pump when the direction of rotation of the input is clockwise and the swing gear engages the drive gear of the other pump when the direction of rotation of the input is counterclockwise.

17 Claims, 6 Drawing Sheets

PRIMING SYSTEM FOR MULTICOLOR INK JET PRINTERS

BACKGROUND OF THE INVENTION

The present invention relates to priming of thermal ink jet printheads and, more particularly, to a priming system located at a maintenance station for a multicolor ink jet printer having at least one peristaltic priming pump which selectively primes either a black ink printing printhead or a color ink printing printhead.

Thermal ink jet printing systems use thermal energy pulses generated by the heating elements in an ink jet printhead to produce momentary ink vapor bubbles on the heating elements which eject ink droplets from the printhead nozzles. One type of such a printhead has a plurality of parallel ink channels, each communicating at one end with an ink reservoir and having opposing open ends which serve as nozzles on the droplet emitting face of the printhead. A heating element, usually a resistor, is located in each of the ink channels a predetermined distance upstream from the nozzle openings. The heating elements are individually driven with a current pulse to momentarily vaporize the ink and form a bubble which expels a droplet of ink. The channel is then refilled by capillary action, drawing ink from a supply tank. A meniscus is formed at each nozzle under a slight negative pressure to prevent ink from weeping therefrom. Operation of a thermal ink jet printer is described, for example, in U.S. Pat. No. 4,849,774 and U.S. Pat. No. 4,571,599.

The carriage type ink jet printer, of which the present invention relates, typically has one or more small printheads containing the ink channels and nozzles in a nozzle face. The printheads are connected to an ink supply tank. In one configuration, the printhead and one or more ink tanks are integrally assembled and the entire configuration, sometimes referred to as a cartridge, is disposable when the ink in the ink tanks are depleted. In another configuration, the printhead is an integral part of a replaceable ink tank support and replaceable ink supply tanks are installed on the ink tank support. Generally, the ink tank support is first installed on the printer's translatable carriage and then the ink supply tanks are installed. Each of the ink supply tanks is replaced when the ink contained therein is depleted. The replaceable ink tank support should not need to be replaced until at least ten ink supply tanks have been emptied during printing operations.

For carriage type multicolor ink jet printers of the latter type, there is a replaceable ink tank support for printing black ink and a separate replaceable ink tank support for printing non-black inks. These ink tank supports are installed on the printer's carriage and then the respective ink tanks are installed on the appropriate ink tank support. Whether the carriage type ink jet printer uses replaceable cartridges comprising integral printheads and ink supply tanks or replaceable ink tank supports with integral printheads and separate replaceable ink tanks, both types are translated in a printing zone in one direction to print a swath of information on a recording medium, such as paper. The swath height is equal to the length of the column of nozzles in the printhead's nozzle face. The paper is held stationary during the printing and, after the swath is printed, the paper is stepped a distance equal to the height of the printed swath or a portion thereof. This procedure is repeated until the entire page is printed or until all information has been printed, if less than a page. For an example of a typical ink cartridge, refer to U.S. Pat. No. 5,519,425 which discloses disposable ink cartridges having integral printheads and ink supply tanks, and refer to U.S. Pat. No. 5,971,531 for a replaceable ink tank support having integral printheads and separately replaceable ink supply tanks.

As is well known, the thermal ink jet printheads of the carriage type printers require maintenance usually at a maintenance station located to one side of the printing zone, where the printhead nozzle faces are periodically cleaned during and after a printing operation. At the completion of a printing operation, the printhead is translated by the carriage to the maintenance station where the printhead nozzle face is sealingly covered by a cap to keep the ink in the nozzles from drying out. In addition, the printhead may be primed while capped to ensure that the printhead channels are completely filled with ink and contain no print inhibiting air bubbles. The non-used or little used nozzles may be cleared by translating the printhead to the maintenance station and ejecting ink droplets from those nozzles into, for example, a 'spittoon' or the cap. The cleaning of the printhead nozzle faces are generally accomplished by using wiper blades which wipe the nozzle faces as they enter and/or leave the maintenance station. Refer to U.S. Pat. No. 5,404,158 for a typical maintenance station.

In many existing thermal ink jet printers, peristaltic pumps have been used to effect priming of a capped printhead, where priming is defined as filling the flow paths of the printhead and other ink flow passageways between the printhead nozzles and the ink supply tank. Although the priming can be done by temporarily using positive pressure on the ink in the ink tank to force ink and entrained air and/or air bubbles out of the ink flow paths, it is more popular to use a vacuum or suction on the nozzles to withdraw some ink and thus any trapped air from the printhead.

U.S. Pat. No. 6,220,699 discloses a printer apparatus and method of actuating a fluid pump to deliver fluid to an ink jet printhead without removing the printhead from a printhead carriage that is particularly useful for priming ink jet printheads using an air displacement pump to deliver air under positive pressure to the printheads. The pump is located proximate a maintenance station on the printer and is automatically actuated by movement of the carriage to the maintenance station.

U.S. Pat. No. 5,572,243 discloses a priming element for priming or maintaining the nozzles or orifices of an ink jet printer. The priming element applies a vacuum or negative pressure generated by a suction device to the nozzles. The priming element includes a first wall and a second wall spaced from the first wall to define a passageway between the first wall and the second wall. One or more support members connect the first wall to the second wall and span the passageway to prevent the walls of the priming element from collapsing from the applied vacuum or negative pressure.

U.S. Pat. No. 5,757,398 discloses a liquid ink printer forming images on a recording medium including a liquid ink printhead movable between a printing position and a maintenance position and a maintenance arrangement, located at the maintenance position, including a driver, a first mechanism and a second mechanism. The driver is coupled to the first mechanism and to the second mechanism and moves in a first direction to actuate the first mechanism and in a second direction to actuate the second mechanism. The driver includes a stepper motor having a single shaft coupled to the first mechanism, such as a cam bank or rotary valve, and to the second mechanism, such as a vacuum pump, through a unidirectional clutch.

U.S. Pat. No. 6,130,684 discloses an ink jet printer which includes a capping and wiping system in a maintenance station that is connected to a common vacuum source. The wiping system includes a blotter type collection member which presents an air vent when the printhead is in a capped position. When a priming operation is initiated, the air vent route is blocked, and full pressure is applied at the capping nozzle interface.

In one known multicolor ink jet printer, the printhead is primed at the maintenance station by evacuating the cap while it sealingly covers the printhead nozzle face. A typical system to prime printheads using a vacuum or negative pressure is to place a peristaltic pump in a line interconnecting the waste ink collector to the cap. Using this technique in a multicolor ink jet printer requires that both the printhead which prints with black ink and the printhead which prints with non-black ink, i.e., cyan, magenta, and yellow inks, were primed concurrently when only one or the other of the printheads actually needed to be primed. This failure to be able to individually prime the printheads increases the amount of ink wasted by priming, thereby reducing the total number of printed pages the customer could get from an ink tank.

SUMMARY OF THE INVENTION

It is an object of the present invention to provide an improved priming system for a multicolor ink jet printer by eliminating the concurrent priming of both the black ink printing printhead and the color or non-black ink printing printhead when only one printhead requires priming. This is accomplished by two individual peristaltic pumps having a single mechanical input which selectively drives the pumps. This system thus separates the vacuum necessary to prime one printhead from the other by using the direction of the single mechanical input, coupled with a swing gear, as the means to control the operation of one pump and render the other pump inoperable.

In one aspect of the present invention, there is provided a priming system for a multicolor ink jet printer having a black ink printing printhead and a non-black ink printing printhead mounted on a translatable carriage for concurrent movement therewith, the translatable carriage being translated across a printing zone during a printing operation and being translated to a maintenance station when the printer is in a non-printing operation for printhead cleaning and capping of each printhead by a separate cap, the priming system comprising: two individual peristaltic pumps, each of said pumps having a tube therethrough, one end of the tubes being connected to a waste ink collector, each of the other ends of the tubes being connected to a respective one of the caps in said maintenance station, one of said pumps being operable when driven in a first direction and the other of said pumps being operable when driven in a second direction; a positionable swing gear being selectively positioned into driving engagement with a selected one of said pumps; a drive gear being in continual driving engagement with said swing gear; and a bi-directional drive means for selectively driving the drive gear in either a first or a second direction to selectively effect operation of the desired one of the pumps to produce a vacuum between the selected printhead and said pump, thereby preventing concurrent priming of both printheads when only one printhead requires priming.

BRIEF DESCRIPTION OF THE DRAWINGS

The present invention will now be described, by way of example, with reference to the accompanying drawings, in which like reference numerals refer to like elements, and in which.

DESCRIPTION OF THE PREFERRED EMBODIMENT

Figure 1:
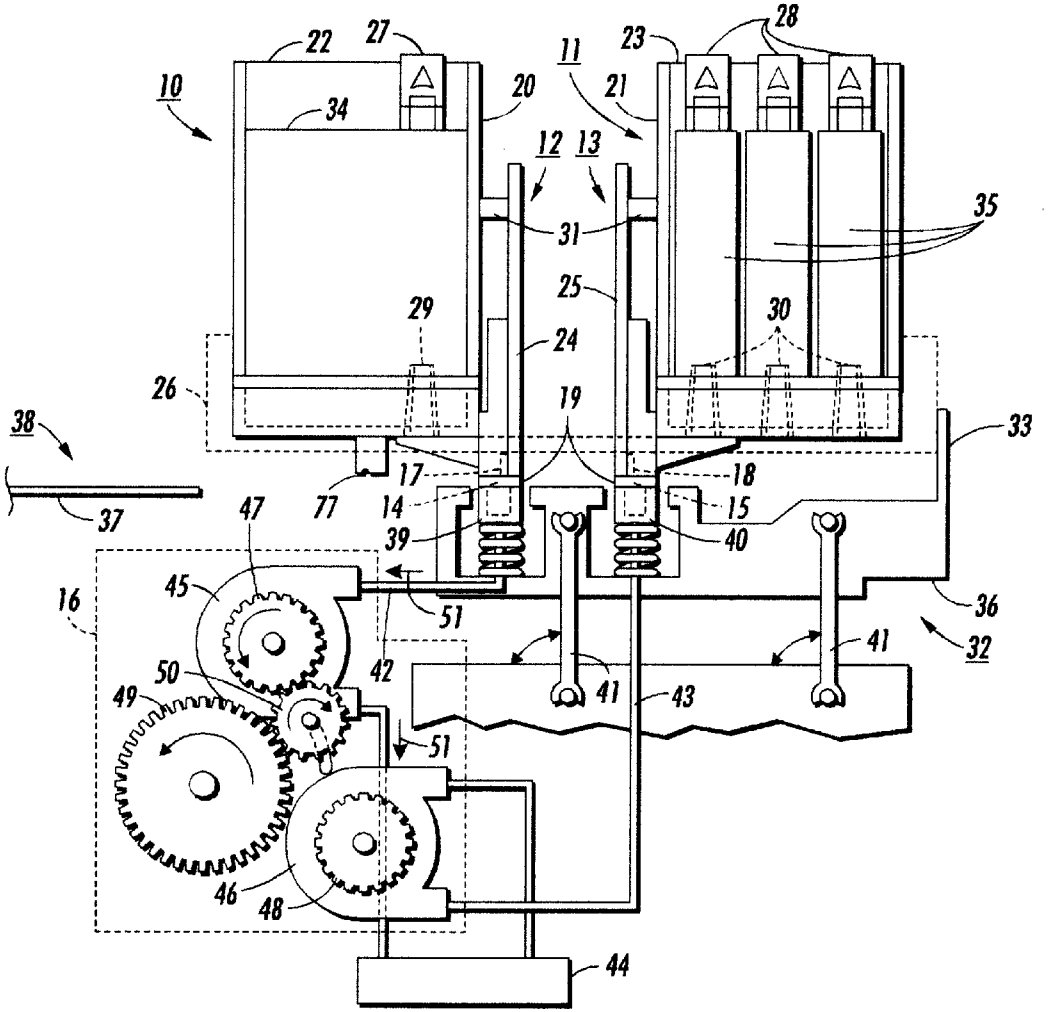
FIG. 1 is a schematic elevation view of a multicolor ink jet printhead for an ink jet printer that is shown mounted on a translatable carriage, shown in dashed line, with the carriage being located at the printer's maintenance station with only the black ink printhead being primed by the priming system of the present invention.

In FIG. 1, a schematic elevation view of a translatable carriage 26 (shown in dashed line) of an ink jet printer (not shown) is depicted with the carriage being located at the printer's maintenance station 32. The carriage has thereon one ink tank support structure 10 for a replaceable black ink tank 34 and one ink tank support structure 11 for separate replaceable multicolor ink tanks 35. There are three multicolor tanks in the preferred embodiment, but they may also be replaced with a single integral tank containing three separate chambers (not shown). Each tank or chamber has respective cyan, magenta, and yellow inks therein. The ink tank support structures 10, 11 each include a respective printhead assembly 12, 13 fixedly mounted thereto. Each printhead assembly 12, 13 comprises a respective printhead 17, 18 and an interfacing circuit board (not shown) attached to a respective heat sink 24, 25. Each printhead has a nozzle face 14, 15 which contains the ink droplet emitting nozzles (not shown). A thin frame member 19 of suitable material, such as, for example, Mylar®, surrounds each printhead nozzle face 14, 15 and is coplanar therewith. The frame members aid in the cleaning of the nozzle faces by wiper blades (not shown) which are located at the maintenance station and clean the nozzle faces each time the carriage translates the printhead assemblies to the maintenance station. A backstop receptacle 77 is integrally formed on the outer surface of the floor of the ink tank support structure 10 for collecting residual ink flicked from the wiping blades which clean the black ink printing printhead 17.

The support structure 10 contains black ink tank 34 and has a side wall 20 to which printhead assembly 12 is attached. The support structure 11 contains the three separate multicolor ink tanks and has a side wall 21 to which printhead assembly 13 is attached. The support structures 10, 11 each have respective latching arms 27, 28 integrally formed in a respective back wall 22, 23. Ink flow passages (not shown) are formed in the floor of each support structure. The ink flow passages interconnect respective ink pipe connectors 29, 30 integrally formed in the floor of their respective support structures to ink inlets (not shown) of respective printheads 17, 18 which are attached to the support structures with their inlets aligned with the outlets (not shown) of the ink flow passages. The printhead assemblies 12, 13 are attached to the support structures by adhesives and staked posts 31 which pass through the heat sinks, thus sandwiching the printheads between respective housing side walls and heat sinks. The ends of the respective latching arms 27, 28 lock the respective ink tanks 34, 35 in place on their respective ink tank support structures 10, 11 with respective ink pipe connectors 29, 30 of the ink tank support structures inserted therein.

The carriage 26 is shown positioned at the maintenance station 32 of the printer, which is located to one side of the printing zone 38 where the recording medium, such as paper 37 is held on a platen (not shown). The maintenance station has a positionable member 36 with a lever arm 33. The positionable member 36 contains the caps 39, 40 which are spring biased in a direction providing sealing contact with the frame members 19 which surround the printhead nozzle faces 14, 15. As the carriage 26 translates from the printing zone 38 into the maintenance station 32, the carriage engages the lever arm 33 of the positionable member and rotates the positionable member about hinged supports 41, thereby bringing the caps into sealing contact with the frame members which surround the printhead nozzle faces. Thus, the caps seal the nozzles in the nozzle faces from ambient air. The priming system of the present invention is located at the maintenance station 32 and comprises a vacuum source in the form of a peristaltic pump 45, 46 for each respective cap 39, 40, a waste ink collector in the form of an enclosed absorbent member 44, and tubing 42, 43 which interconnect respective caps to the absorbent member. Thus, each cap has a flexible tubing 42, 43 connected thereto which passes through a respective one of the peristaltic pumps 45, 46 and is then connected to an enclosed absorbent member 44 which is capable of storing waste ink removed by the peristaltic pumps during a priming operation. In the preferred embodiment the peristaltic pumps 45, 46 are enclosed in a single, two-part housing 16, shown in dashed line, but the pumps may have separate housings.

Each peristaltic pump has a respective rotor drive gear 47, 48 individually driven by a positionable swing gear 50, as discussed later. The swing gear is engaged with and driven by a single input gear 49, and the direction of rotation of the input gear determines the direction of rotation of the swing gear and its position relative to the pump drive gears. The input gear is powered by a reversible electric motor (not shown) or any other suitable bi-directional drive means. In FIG. 1, the input gear is driven in the counterclockwise direction, rotating the swing gear in the clockwise direction and swinging it into meshing engagement with rotor drive gear 47 of pump 45, thereby driving drive gear 47 in the counterclockwise direction and priming the black ink printhead 17. Ink is removed from the printhead 17, together with any air bubbles therein, by the vacuum produced by peristaltic pump 45. The removed ink and air bubbles travel from the printhead to the cap 39, through tubing 42, and to the absorbent member 44, as indicated by arrows 51.

Figure 2:
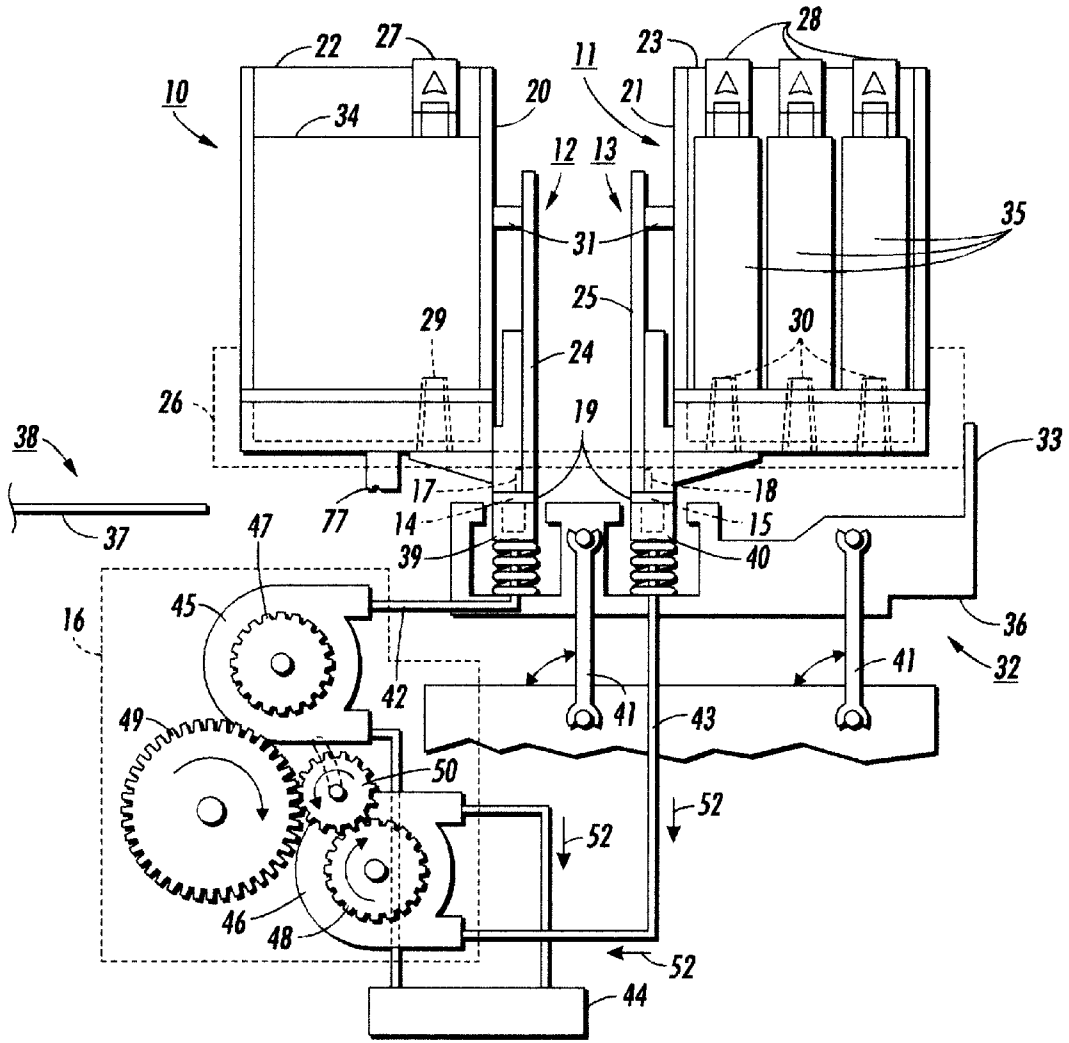
FIG. 2 is a view similar to FIG. 1, except only the tricolor ink printhead is being primed by the priming system of the present invention.

FIG. 2 is the same as FIG. 1, except the input gear 49 is driven in the clockwise direction, thus swinging the swing gear 50 into engagement with the rotor drive gear 48 of peristaltic pump 46. This rotates the swing gear in the counterclockwise direction and moves it into driving engagement of the rotor drive gear 48 of peristaltic pump 46. Rotor drive gear 48 is rotated in the clockwise direction and causes the peristaltic pump to produce a vacuum in cap 40 and thus prime printhead 18. The printhead 18 is referred to as the tricolor printhead because it prints ink from the three color ink tanks 35. The ink and air bubbles removed from tricolor printhead 18 by peristaltic pump 46 travels from the tricolor printhead into cap 40, through tubing 43 and to the absorbent member 44, as indicated by arrows 52.

Figure 3:
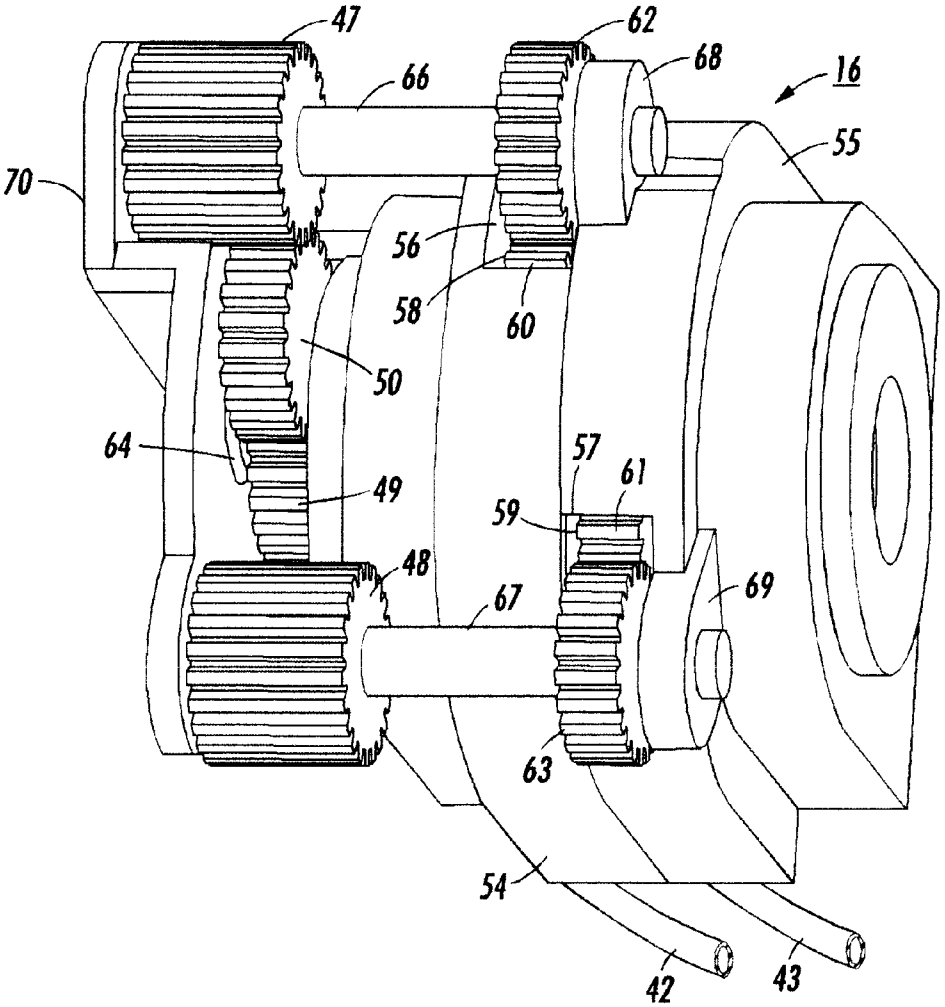
FIG. 3 is an isometric view of the two peristaltic pumps used by the priming system shown in FIGS. 1 and 2.

FIG. 3 is an isometric view of the two peristaltic pumps 45, 46, which are enclosed by a single housing 16, comprising two parts 54, 55. One housing part 55 contains the peristaltic pump for priming the tricolor ink printhead 18, and the other housing part 54 contains the peristaltic pump for priming the black ink printhead 17. The two housing parts 54, 55 have respective openings 56, 57 which expose the respective circular pump rotors 58, 59, which are coaxially mounted for rotation when driven, as explained later. Each of the rotors has gear teeth 60, 61 on their respective circular outer edges which are engaged by a respective first rotor gear 62, 63. The respective first rotor gears 62, 63 and a respective one of the rotor drive gears 47, 48 are mounted on opposing ends of a respective rotor drive shaft 66, 67. The drive shafts 66, 67 are parallel to each other and are rotatably mounted at their opposing ends with the rotor drive gears 47, 48 and first rotor gears 62, 63 fixed or keyed thereto. One end of each drive shaft is rotatably mounted in respective integral extensions 68, 69 which extend from the housing part 55 containing the priming pump for the tricolor ink printhead. The other ends of the respective drive shafts are rotatably mounted in a cover plate 70 that is fastened to the housing part 54 containing the priming pump for the black ink printhead. The input drive gear 49 with an integral shaft is located between the cover plate 70 and the housing part 54 containing the priming pump for the black ink printhead. One end of the opposing ends of the integral shaft of the input drive gear is mounted for rotation in the cover plate and the other opposing end of the integral shaft is mounted for rotation in the housing part 54, with the axis of rotation of the input drive gear being parallel to the rotor drive shafts 66, 67. A swing gear 50 has an integral shaft which rotates in arcuate grooves 64, 65. The arcuate grooves enable the swing gear to rotate therein and to be selectively moved or swing therealong from one rotor drive gear to the other. Arcuate groove 64 is in the cover plate 70 while arcuate groove 65 is in the housing part 54. The swing gear shaft and its axis of rotation are parallel to input drive shaft and rotor drive shafts of the peristaltic pumps. The swing gear remains in continual engagement with the input drive gear 49, but moves along the grooves 64, 65 and into selective engagement with one of the rotor drive gears 47, 48 depending upon the direction of rotation of the input drive gear 49. The torque provided by the input drive gear 49 to the swing gear 50 moves the swing gear along the arcuate grooves 64, 65 (see also FIG. 4) and into selective engagement with the desired rotor drive gear 47, 48, as well as rotates the swing gear, thus driving the selected rotor drive gear.

Figure 4:
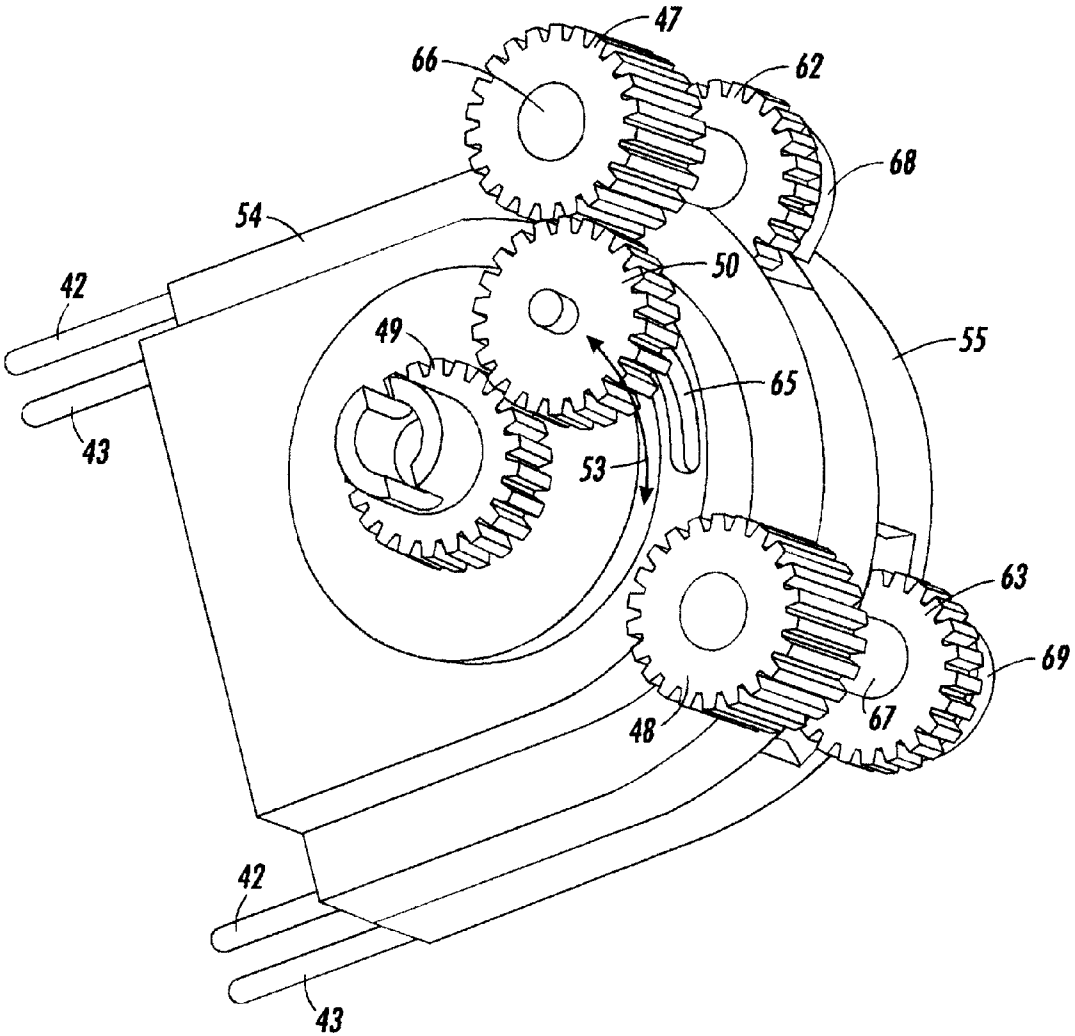
FIG. 4 is an isometric view of the two peristaltic pumps shown in FIG. 3 with the cover plate removed to show the swing gear which selectively drives either the black ink priming peristaltic pump or the tricolor ink priming peristaltic pump depending upon the direction of rotation of the drive input to the swing gear.

In FIG. 4, an isometric view of the two peristaltic pumps is shown with the cover plate 70 removed to expose the input gear 49, swing gear 50, and the two rotor drive gears 47, 48. The swing gear is shown having been moved along the arcuate grooves 64, 65, as indicated by arrow 53, into driving engagement with the rotor drive gear 47. Since the rotor drive gear 47 and the first rotor gear 62 are commonly fixed to the rotor drive shaft 66, by for example, keys, rotation of the rotor drive gear rotates the rotor 58 through the first rotor gear 62 and produces the vacuum to prime the black ink printhead 17.

Figure 5:
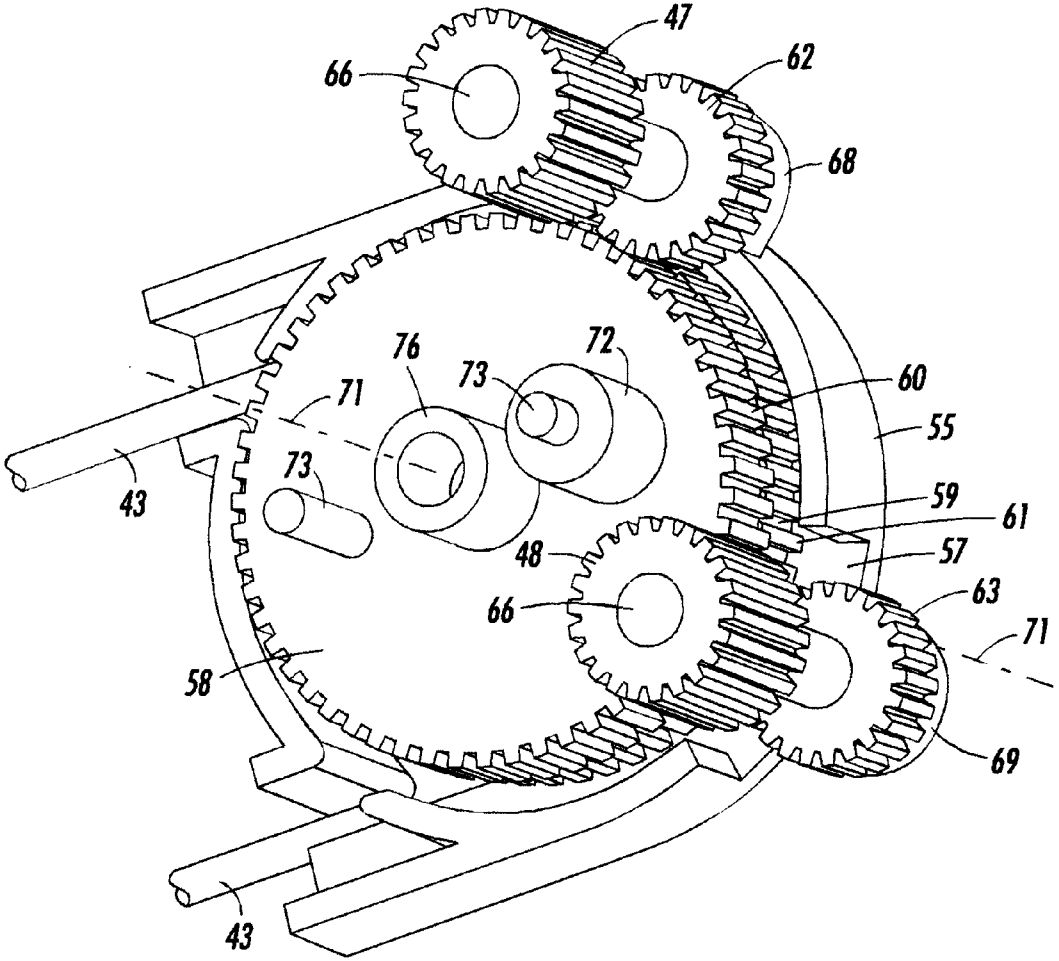
FIG. 5 is an isometric view of the two peristaltic pumps of the priming system of the present invention, partially assembled to show a portion of the black ink priming peristaltic pump.
Figure 6:
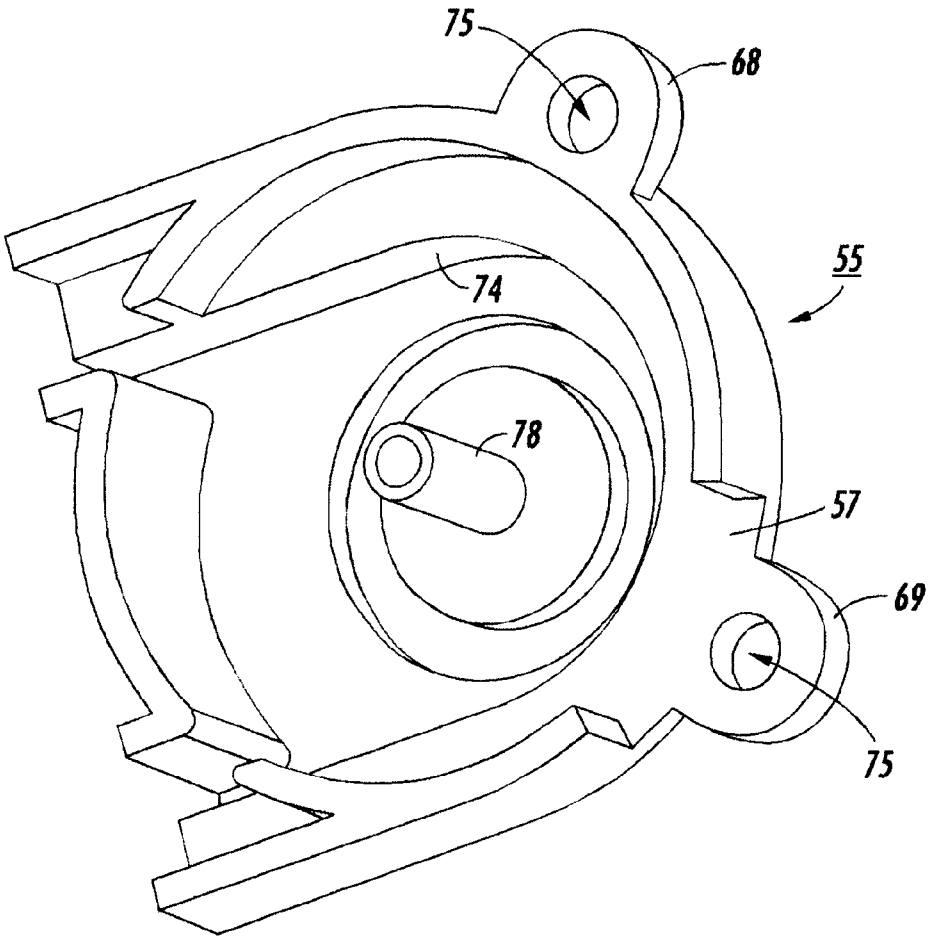
FIG. 6 is an isometric view of the housing portion of the dual peristaltic pumps shown in FIG. 3, which houses the tricolor ink priming peristaltic pump.

Referring also to FIG. 5, an isometric view of the two peristaltic pumps of FIG. 4 is shown as partially disassembled. The input gear 49, swing gear 50, housing part 54, and tubing 42 have been removed in FIG. 5 to show the rotor 58 and its two pump rollers 72 (only one shown). The pump rollers are rotatably mounted on fixed or integral shafts 73 which extend from one side of the rotor 58. The rollers 72 are spaced apart by 180° and pinch the tubing 42 (not shown in this view) against an internal circular surface of housing part 54 (not shown in this view, but a similar internal circular surface 74 of housing part 55 is shown in FIG. 6). The internal circular surfaces 74 are spaced a predetermined distance from and substantially parallel with a theoretical cylindrically shaped plane (not shown) that is tangent to the outer surface of the two pump rollers 72. The cylindrical plane could also be visualized as being formed by the rotation of the rotor with the outer surfaces of the two pump rollers 72 drawing the cylindrical plane. The predetermined spacing distance from the pump rollers 72 to the internal circular surfaces is based upon the wall thickness of the tubing 42, 43 and the tubing resilience. Generally, the spacing distance is about equal to the height of a flattened tubing which has been squeezed or pinched flat by the pump rollers. The length of the internal circular surfaces is about 185° to ensure that the vacuum generated by the peristaltic pumps is not released when one of the rollers leaves the 185° tubing compression area 74.

In a manner similar to a typical peristaltic pump, the spaced rollers 72 on the rotor 58 squeeze or compress the tubing 42 against the internal circular surface of housing part 54. The tubing is stationary, so as the rotor rotates about its axis, the rollers roll along the tubing pushing any air and/or liquid trapped in the tubing between the rollers in the compression area of the circular surface. In continuing reference to FIG. 5, a permanently attached or integral hollow sleeve 76 extends from the center of the same surface of the rotor 58 as the shafts 73 and functions as a bearing or bushing for the rotor. A shaft (not shown) extends internally from the housing part 54, similar to the shaft 78 of housing 55 shown in FIG. 6, and is inserted into the sleeve 76, so when the housing part 54 is mated to the other housing part 55, the rotor 58 and its sleeve 76 rotates about the shaft in the housing part 54.

FIG. 6 is an isometric view of the housing part 55 showing the shaft 78 extending from the interior of the housing part 55. This is similar to the shaft in housing part 54 which extends from the interior thereof. The ear-like extensions 68, 69 are clearly shown to be an integral part of housing part 55 with holes 75 therein through which one end of the rotor drive shafts 66, 67 resides. The internal circular surface 74 is the compression area for the tubing 43 when it is installed, but the tubing 43 is omitted from this view for clarity. The stationary tubing 42, 43 remains in contact with the internal circular surface 74 of respective housing parts 54, 55, and the tubing is progressively compressed by the rotor rollers 72 when the rotors are rotated. This rolling of the pump rollers along the tubing 42, 43 traps the ink and any air in the tubing between the spaced rollers 72 and expels the ink and air to the waste ink collector 44 as the rotor is rotated, thus producing the vacuum required for priming the printheads. The rotor 59 is similar to the rotor 58 shown in FIG. 5, and is installed on the shaft 78. When the two peristaltic pumps 45, 46 are assembled and the two housing parts 54, 55 are mated to form a single housing 16, the shafts 78 touch each other and are coaxial, so the rotors 58, 59 rotate about a single axis, but in opposite directions.

Although the foregoing description illustrates the preferred embodiment, other variations are possible and all such variations as will be apparent to those skilled in the art are intended to be included within the scope of this invention as defined by the following claims.

What is claimed is:

1. A priming system for a multicolor ink jet printer having a black ink printing printhead and a non-black ink printing printhead mounted on a translatable carriage for concurrent translation therewith and a maintenance station which has an individual cap for each printhead, the caps cover the printhead nozzle faces when the carriage translates the printheads thereto, the priming system comprising two individual peristaltic pumps, one pump for generating a vacuum for priming said black ink printing printhead and the other pump for generating a vacuum for priming said non-black printing printhead, each pump having a respective drive gear, a single swing gear moveable between a position of driving engagement with the drive gear of a selected one of the pumps and a position of driving engagement with the drive gear of the other pump, and a single input driver that drives the swing gear and moves the swing gear into selective engagement with the drive gear of the desired pump.

2. The priming system as claimed in claim 1, wherein each pump further comprises a rotatably mounted circular rotor having gear teeth formed on the rotor's outer circular surface, the gear teeth of each rotor engaging a respective one the drive gears.

3. The priming system as claimed in claim 2, wherein the pump rotors are coaxially mounted for rotation about the same axis; and wherein each pump rotor further comprises a pair of pump rollers, each of which are mounted for rotation on one of a pair of shafts extending from a surface of each of said pump rotors, said shafts with the rollers thereon being spaced apart 180°.

4. The priming system as claimed in claim 3, wherein each of the pumps further comprise a tubing connected at one end to one of the caps and the other end is connected to a waste ink collector.

5. The priming system as claimed in claim 4, wherein each of said pumps further comprise a housing part, the housing part having an internal circular surface upon which a respective tubing resides in contact therewith, each internal circular surface serves as a compression area for the tubing and is substantially parallel to and spaced a predetermined distance from a cylindrical plane which is tangent to the outer surfaces of a respective pair of pump rollers, the predetermined distance between the internal circular surface of the housing part and the cylindrical plane is substantially equal to the thickness of said tubing when flattened against the internal circular surface by a one of said pair of pump rollers.

6. The priming system as claimed in claim 5, wherein the length of each internal circular surface of each housing part is about 185°, so that a vacuum generated by said pump is not released when one of the pump rollers leaves the tubing compression area.

7. The priming system as claimed in claim 6, wherein the housing part of each pump are mated together to form a single housing for both pumps.

8. The priming system as claimed in claim 7, wherein the single input driver is a reversible motor which drives and an input gear which is continually engaged with said swing gear; wherein a cover plate is attached to the housing part containing the pump for priming the black ink printing printhead; and wherein the input gear and swing gear are rotatably mounted between the cover plate and the housing part containing the pump for priming the black ink printing printhead.

9. The priming system as claimed in claim 8, wherein the swing gear has an integral shaft extending from opposite sides thereof about which the swing gear rotates, each of the shafts on said opposite swing gear sides are mounted in a respective one of a pair of arcuate grooves, said grooves guide the swing gear from one pump drive gear to the other pump drive gear depending upon the direction of driving input to the input gear, one of said pair of grooves is formed in the cover plate and the other groove is formed in the housing part containing the pump for priming the black ink printing printhead.

10. The priming system as claimed in claim 9, wherein the direction of driving the pump for priming the black ink printing printhead by the reversible motor is the counterclockwise direction, thereby driving the swing gear in the clockwise direction, which in turn drives the pump drive gear for the pump for priming the black ink printing printhead in the counterclockwise direction, thus producing a vacuum which effects the priming; and wherein the reversible motor applies a torque to the swing gear through the input gear when driving the swing gear in the clockwise direction which causes the swing gear to travel along the arcuate grooves and into driving engagement with the pump drive gear for said pump for priming the black ink printing printhead.

11. The priming system as claimed in claim 9, wherein the direction of driving the pump for priming the non-black ink printing printhead by the reversible motor is the clockwise direction, thereby driving the swing gear in the counterclockwise direction, which in turn drives the pump drive gear for the pump for priming the non-black ink printing printhead in the clockwise direction thus producing a vacuum which effects the priming; and wherein the reversible motor applies a torque to the swing gear through the input gear when driving the swing gear in the counterclockwise direction, which causes the swing gear to travel along the arcuate grooves and into driving engagement with the pump drive gear for said pump for priming the non-black ink printing printhead.

12. The priming system as claimed in claim 9, wherein each of the respective drive gears of the pumps comprise a rotor drive gear and a first rotor gear, both of which are commonly mounted on opposing end portions of a respective rotor drive shaft; wherein the end of each respective rotor drive shaft adjacent the rotor drive gear is rotatably mounted in the cover plate and the other ends of the respective rotor drive shafts are rotatably mounted in respective extensions on the housing part containing the pump for priming the non-black ink printing printhead; and wherein the swing gear selectively engages a respective one of the rotor drive gears while the respective first rotor gears remain continually engaged with the gear teeth on the outer circular surface of the respective rotors.

13. The priming system as claimed in claim 12, wherein the first rotor gears engage the gear teeth on the outer circular surface of the respective rotor through separate respective openings in the housing part containing the pump for priming the non-black ink printing printhead.

14. The priming system as claimed in claim 13, wherein the input gear, swing gear, rotor drive gear and commonly mounted first rotor gear, and the rotor have axes of rotation that are parallel to each other.

15. A priming system for a multicolor ink jet printer having a black ink printing printhead and a non-black ink printing printhead mounted on a translatable carriage for concurrent movement therewith, the translatable carriage being translated across a printing zone during a printing operation and being translated to a maintenance station when the printer is in a non-printing operation for printhead cleaning and capping of each printhead by a separate cap, the priming system comprising: two individual peristaltic pumps, each of said pumps having a tube therethrough, one end of the tubes being connected to a waste ink collector, each of the other ends of the tubes being connected to a respective one of the caps in said maintenance station, one of said pumps being operable when driven in a first direction and the other of said pumps being operable when driven in a second direction; a positionable swing gear being selectively positioned into driving engagement with a selected one of said pumps; a drive gear being in continual driving engagement with said swing gear; and a bi-directional drive means for selectively driving the drive gear in either a first or a second direction to selectively position the swing gear and effect operation of the desired one of the pumps, thereby preventing concurrent priming of both printheads when only one printhead requires priming.

16. The priming system as claimed in claim 15, wherein the swing gear is mounted for rotation in arcuate grooves; and wherein the driving of the swing gear by the drive means through the drive gear produces a torque on the swing gear which positions the swing gear along the grooves and into engagement with the desired pump.

17. The priming system as claimed in claim 16, wherein the two pumps are mounted in a single housing.

* * * * *